US006375106B1

(12) United States Patent
Sears

(10) Patent No.: US 6,375,106 B1
(45) Date of Patent: Apr. 23, 2002

(54) WASTE REDUCTION MACHINE WITH REPLACEABLE TEETH

(75) Inventor: Todd Sears, Clackamas, OR (US)

(73) Assignee: SSI Shredding Systems, Inc., Wilsonville, OR (US)

( * ) Notice: Subject to any disclaimer, the term of this patent is extended or adjusted under 35 U.S.C. 154(b) by 0 days.

(21) Appl. No.: 09/574,667

(22) Filed: May 18, 2000

(51) Int. Cl.[7] ..... B02C 18/18
(52) U.S. Cl. ..... 241/294; 241/236
(58) Field of Search ..... 241/236, 282.2, 241/294, 295

(56) References Cited

U.S. PATENT DOCUMENTS 432,758 A * 7/1890 Mills ..... 241/294
1,032,081 A * 7/1912 Penn ..... 241/294
4,241,882 A * 12/1980 Baikoff ..... 241/295
4,826,090 A * 5/1989 Orphall ..... 241/294
5,873,534 A * 2/1999 Shinn ..... 241/294
5,988,544 A * 11/1999 Williams, Jr. ..... 241/295

FOREIGN PATENT DOCUMENTS

GB 564006 * 9/1944 ..... 241/294

* cited by examiner

*Primary Examiner*—Lowell A. Larson
(74) *Attorney, Agent, or Firm*—Chernoff, Vilhauer, McClung & Stenzel, LLP

(57) ABSTRACT

A blade assembly for a waste reduction machine includes a hub which is mounted on a rotatable shaft. A plurality of attachment devices are located at spaced-apart intervals on the periphery of the hub. Each attachment device has a tooth releasably attached to it. The attachment device includes an elongate threaded element which is oriented generally perpendicular to a radial line on the hub which intersects the threaded element. The threaded element engages the tooth and pulls it onto or pushes it off of the attachment device. The attachment device includes an elongate locking element and the tooth includes a slot which slidingly interfits onto the locking element. The locking element and slot are configured so as to prevent the tooth from moving radially outwardly from the periphery of the hub.

11 Claims, 4 Drawing Sheets

WASTE REDUCTION MACHINE WITH REPLACEABLE TEETH

BACKGROUND AND SUMMARY OF THE INVENTION

This invention relates to a machine which reduces waste material into smaller pieces, and in particular to such a machine which has replaceable teeth on its blade assemblies.

Waste reduction machines are used to break waste material into smaller pieces to make it easier to handle when it is being disposed of. These machines have rotating blade assemblies which engage the material and break it into smaller pieces. The blade assemblies experience considerable wear and breakage so they need to be replaced from time to time. Some of these machines have blade assemblies with replaceable teeth, which allows the teeth to be replaced when they wear or break without having to replace the entire blade assembly. One such machine is shown in Wada, U.S. Pat. No. 5,680,999.

The difficulty with replaceable teeth is that tremendous forces are exerted on the teeth and replaceable teeth are less durable than integral teeth. Replaceable teeth often break at the point of attachment. In addition, replaceable teeth are generally attached to the blade assembly hub with screws, and as the teeth wear the screw heads wear with them and it becomes extremely difficult to remove the screws. As a result it generally is more expensive and time-consuming to replace the teeth of replaceable teeth blade assemblies than it is to replace integral teeth blade assemblies.

The subject invention overcomes the shortcomings and limitations of the prior art replaceable teeth blade assemblies by providing a blade assembly having a hub that is attached to a rotating shaft. Located around the periphery of the hub are a plurality of attachment devices, each of which receives a tooth and attaches the tooth to the hub. In a first preferred embodiment of the invention each attachment device includes a threaded element having an elongate axis which is generally perpendicular to a radial line on the hub which intersects the threaded element. This threaded element secures the tooth to the attachment device.

In another preferred embodiment of the invention each attachment device includes an elongate locking element and each tooth includes an elongate slot which slidably interfits onto the locking element. The locking element and slot are configured to prevent the tooth from moving radially outwardly from the periphery of the hub once the tooth is slid fully onto the locking element. The base of the locking element and the mating portion of the slot are tapered so as to become tightly interconnected when the tooth is fully installed on the attachment device. The threaded element of the first embodiment may be used with this embodiment to pull the tooth fully onto the attachment device against the resistance of the taper and to push it back off again when it needs to be replaced.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
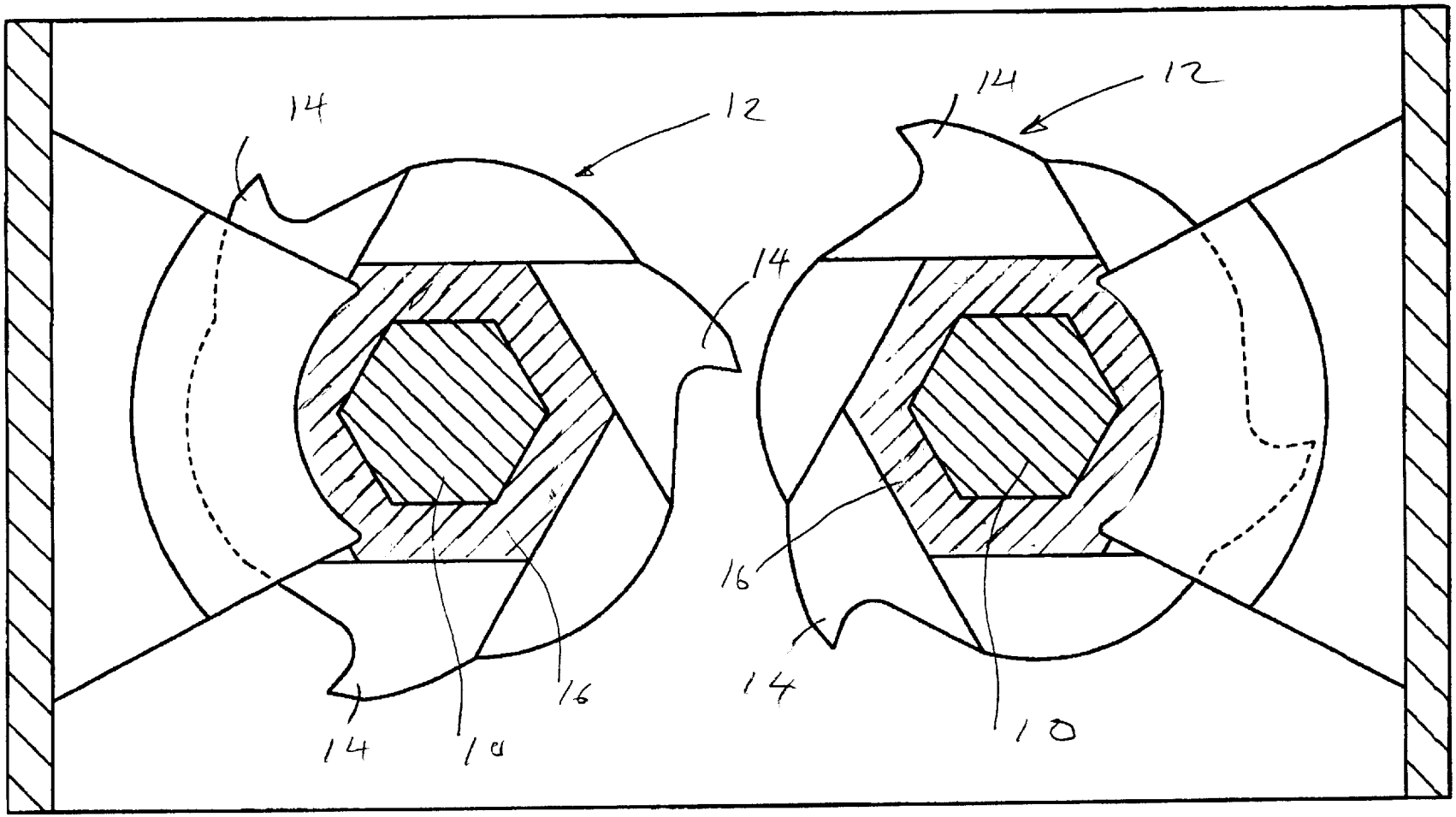
FIG. 1 is a side elevational view in cross-section of a reduction machine showing the blade assembly of the subject invention.

Referring now to FIG. 1 of the drawings, a waste reduction machine has a pair of side-by-side horizontal shafts 10 which are rotated counter to one another by a motor or motors, not shown. In the embodiment illustrated, the shafts are hexagonal in cross-section, but they could have almost any shape. Located on each shaft is a series of side-by-side blade assemblies 12 having protruding shearing tips 14. The blade assemblies are separated from one another by slightly more than their width and the blade assemblies on one shaft are offset from the blade assemblies on the other shaft. Thus, the shearing tips mesh with one another. The shearing tips 14 on the blades on one shaft point in the opposite direction as the shearing tips on the blade assembly on the other shaft and the shafts are counter rotated so that material placed in the reducer is pulled downwardly between the shafts and broken into smaller pieces.

Figure 2:
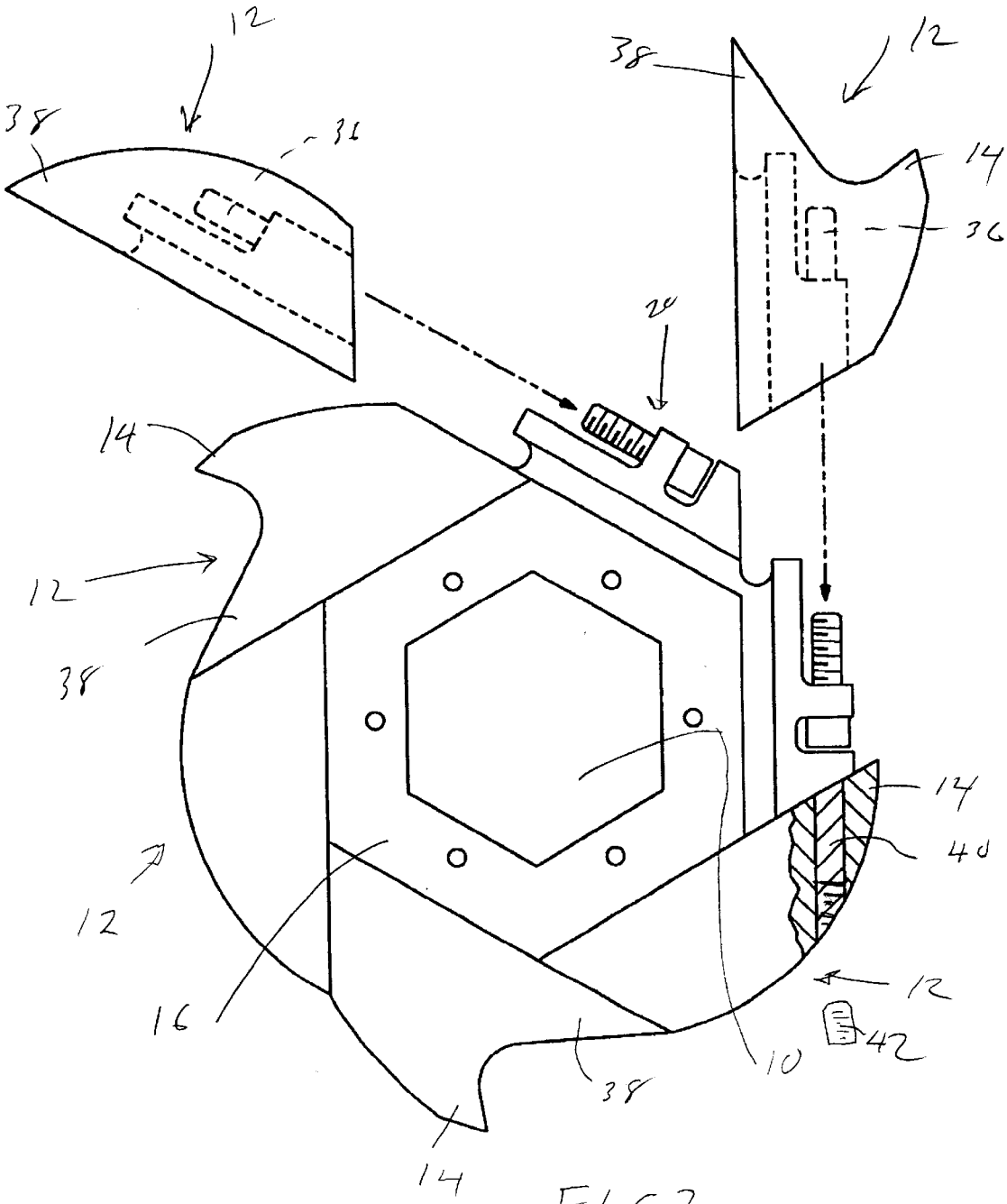
FIG. 2 is a partially exploded view of one of the blade assemblies of the subject invention.
Figure 3:
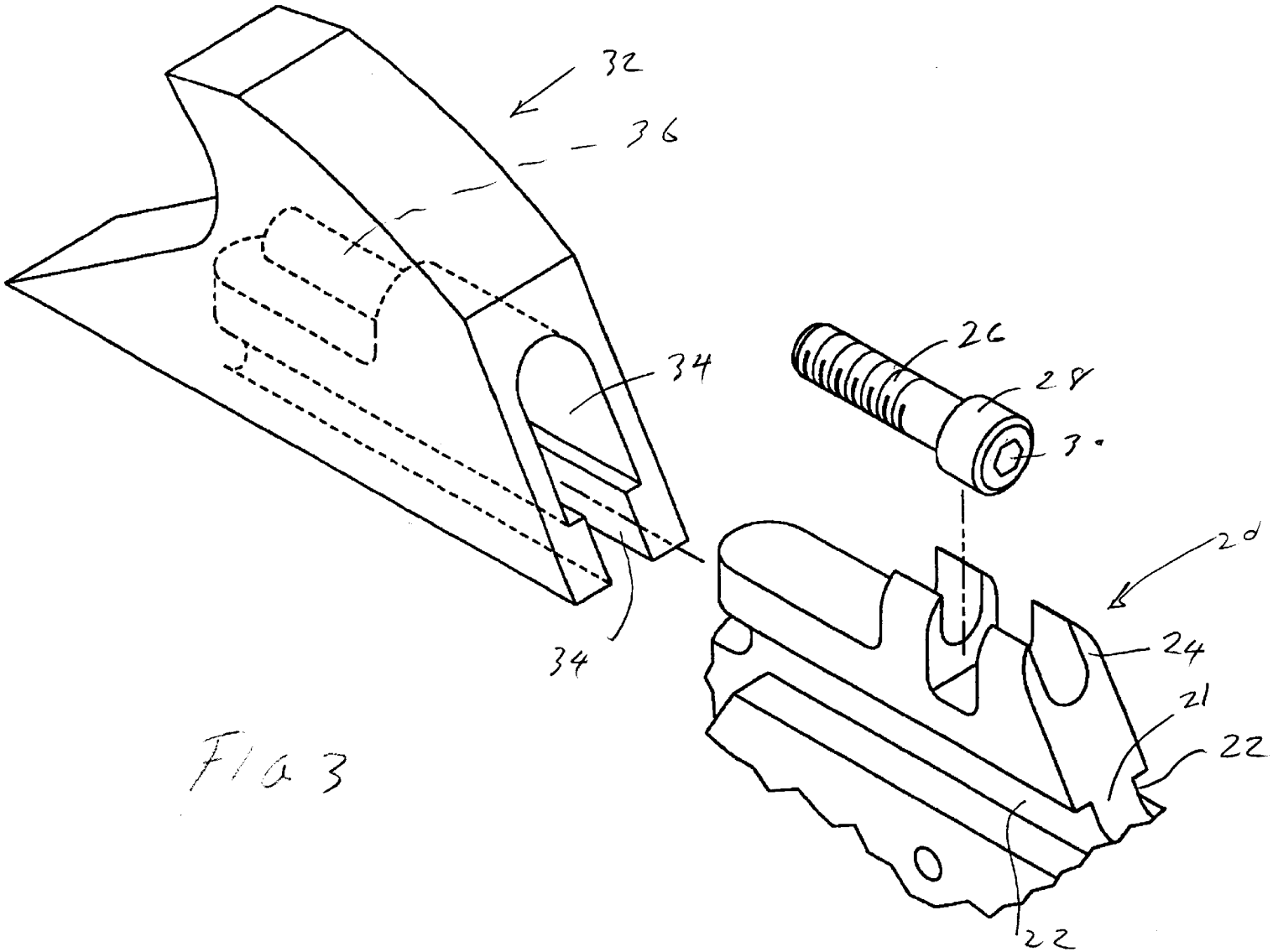
FIG. 3 is an exploded view, at an enlarged scale, showing how teeth are attached to an attachment device.
Figure 4:
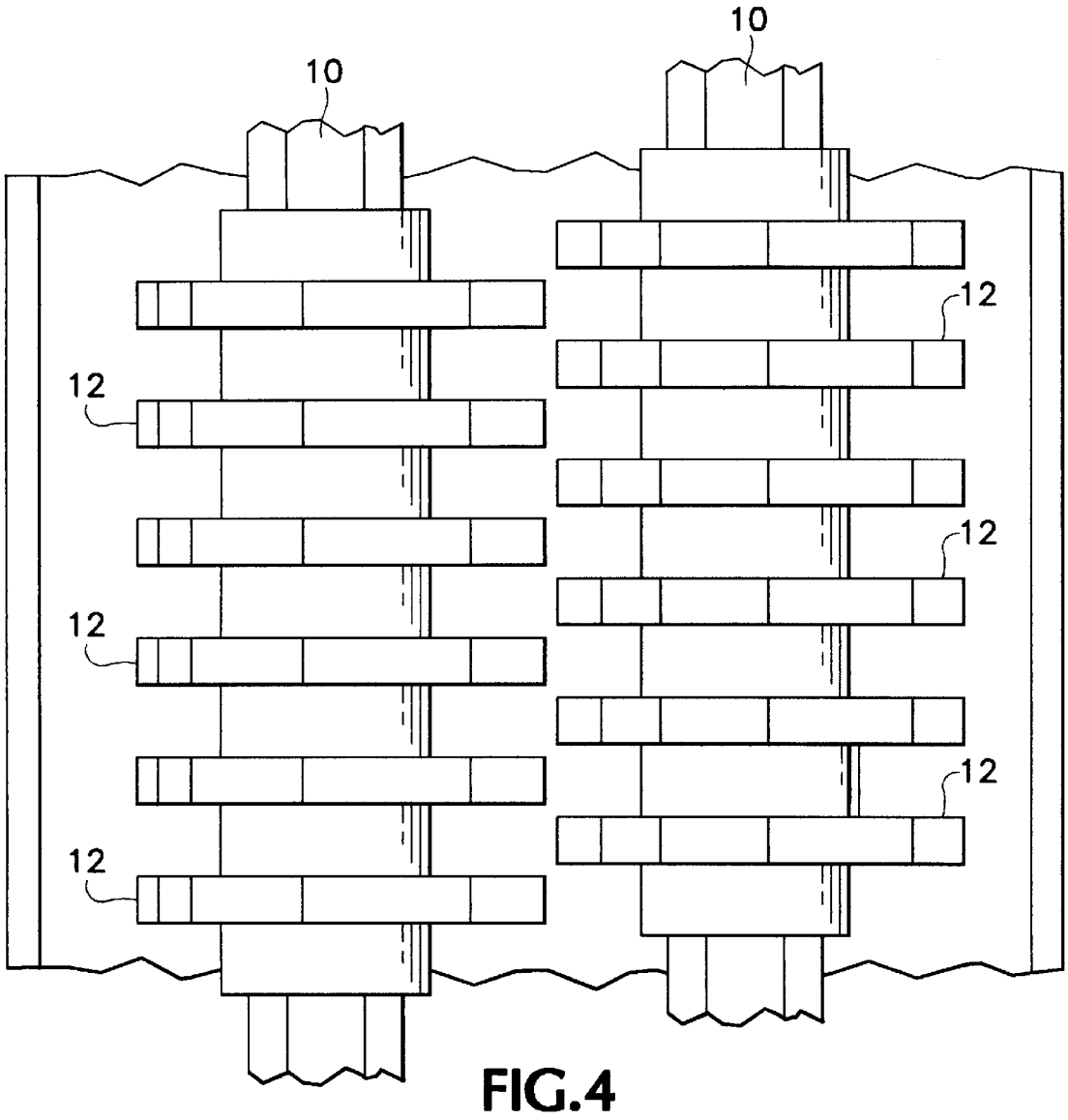
FIG. 4 is a fragmentary plan view of the reduction machine shown in FIG. 1.

Referring now also to FIG. 2, each blade assembly includes a hub 16. A hexagonal opening is located in the center of the hub which tightly receives the shaft 10. Thus the hub rotates with the shaft. Mounted on the hub are a plurality of attachment devices 20. There can be as many attachment devices as desired, but there generally are five or six depending on the type of material being reduced. The attachment devices are evenly spaced about the periphery of the hub. They preferably are integral with the hub, but they can be attached to it. Referring now also to FIG. 3, each attachment device has a locking element 21 which is T-shaped in cross-section and the sides of the upright or base portions 22 of the locking element are tapered as they extend from the front of the device, the left side in the drawings, to the rear of the device. A cradle 24 is located at the top of the attachment device and rotatably carries a threaded element 26. The threaded element 26 has a head 28 which interacts with the cradle to prevent the threaded element from moving along its longitudinal axis. A hex opening 30 in the head 28 allows the threaded element to be rotated with an Allan wrench.

Attached to each attachment device 20 is a tooth 32 which projects outwardly from the periphery of the hub. Each tooth has an elongate slot 34 located in it which slidably interfits onto the locking element 21 of the associated attachment device. When a tooth is on an attachment device, the locking element 21 and the slot 34 interact to prevent the tooth from moving radially outwardly from the periphery of the hub. The sides 34 of the slot have the same taper as the base portions 22 of the locking element. Thus, the tooth becomes rigidly attached to the attachment device when it is urged completely onto it. While the T-shaped locking element and slot shown in the drawings works well, these elements could have other shapes which serve the same function.

Located in the slot 34 in each tooth 32 is a threaded opening 36 which threadedly receives the threaded element 26. The tooth 32 is placed on an attachment device 20 and pushed rearwardly until the threaded element 26 is seated in the threaded opening 36. The threaded element is then rotated to pull the tooth fully onto the attachment device and to seat the tapered sides of the slot 34 on the tapered base portion 22 of the locking element 21. This joins the tooth firmly to the attachment device. When it is time to replace the tooth, the threaded element is rotated in the opposite direction to separate the two tapered parts from one another.

Each tooth 12 has a tail 38 which overlaps an adjacent tooth, FIG. 2. Thus, the tail covers the open end of the cradle through which the hex opening 30 of the threaded element is accessed. This requires the teeth to be installed in a counter-clockwise fashion, as shown in FIG. 2, but it prevents debris from getting jammed in and around the cradle. The first tooth that is installed has an opening 40 in it, which allows access to the threaded element. A plug 42 may be placed in the opening 40 to keep it clear.

As can be seen, only a portion of the teeth have shearing tips 14. How many teeth have shearing tips and how these teeth are arranged depends on the material being reduced.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A cutter for a material reduction machine, comprising a plurality of spaced-apart, side-by-side blade assemblies, each blade assembly including:

(a) An annular hub having a central opening which receives an elongate shaft, said hub having an outer periphery;

(b) A plurality of teeth located around the periphery of said hub;

(c) A plurality of attachment devices mounted on the periphery of said hub at spaced-apart locations, wherein each attachment device releasably attaches one of said teeth to said hub; and (d) Said attachment device includes an elongate locking element and one of said teeth includes an elongate slot which slidingly interfits into said locking element, said locking element and said slot being configured to prevent said one of said teeth from moving radially outwardly from the perimeter of said hub.

2. The blade assembly of claim 1 wherein said locking element and slot are T-shaped in cross-section.

3. The blade assembly of claim 1 wherein a portion of said locking element and the mating portion of said slot are tapered so that said one of said teeth and said attachment device become rigidly interconnected when said one of said teeth is pulled fully onto said attachment device.

4. A blade assembly for a material reduction machine, comprising:

(a) A hub that is fastened to and rotates with an elongate shaft, said hub having an outer periphery;

(b) A plurality of teeth located around the periphery of said hub;

(c) A plurality of attachment devices mounted on the periphery of said hub at spaced-apart locations, wherein each attachment device releasably attaches one of said teeth to said hub; and (d) Each said attachment device including an elongate threaded element having an elongate axis which is generally perpendicular to a radial line on said hub which intersects said threaded element, said threaded element securing one of said teeth to said attachment device, wherein said threaded element pulls said one of said teeth onto and pushes said one of said teeth off of said attachment device.

5. The blade assembly of claim 4 wherein said attachment device includes an elongate locking element and said one of said teeth includes an elongate slot which slidably interfits into said locking element, said locking element and said slot being configured to prevent said one of said teeth from moving radially outwardly from the periphery of said hub when said one of said teeth is located on said locking element.

6. The blade assembly of claim 5 wherein said locking element and said slot are T-shaped in cross section.

7. The blade assembly of claim 6 wherein a portion of said locking element and the mating portion of said slot are tapered so that said one of said teeth and said attachment device become rigidly interconnected when said one of said teeth is pulled fully onto said attachment device by said threaded element.

8. The blade assembly of claim 7 wherein said attachment device has a cradle which rotatably engages said threaded element and prevents said threaded element from moving along its elongate axis, and said one of said teeth contains a threaded opening which threadedly engages said threaded element.

9. The blade assembly of claim 8 wherein said teeth overlap one another and the overlapping portion of one tooth prevents access to the threaded element of the attachment device of an adjacent tooth and at least one of said teeth defines an opening which provides access to the threaded element of the tooth it overlaps.

10. The blade assembly of claim 4 wherein a portion of said teeth have shearing tips and a portion of said teeth do not have shearing tips.

11. The blade assembly of claim 4 wherein said one of said teeth slides onto said attachment device and said one of said teeth and said attachment device have mating tapered surfaces so that said one of said teeth and said attachment device become rigidly interconnected when said one of said teeth is completely slid onto said attachment device.

* * * * *